US005748214A

United States Patent [19]

Usui et al.

[11] Patent Number: 5,748,214

[45] Date of Patent: May 5, 1998

[54] INK JET RECORDING HEAD

[75] Inventors: Minoru Usui; Kazuhiko Hara; Yoshio Miyazawa; Yuji Tanaka; Fujio Akahane; Takahiro Katakura; Shinri Sakai; Yasushi Kishida; Tomoaki Abe; Toshiki Usui; Takeo Seino; Yoshikatsu Yamamoto, all of Nagano, Japan

[73] Assignee: Seiko Epson Corporation, Tokyo, Japan

[21] Appl. No.: 510,996

[22] Filed: Aug. 3, 1995

[30] Foreign Application Priority Data

| | | | |
|---|---|---|---|
| Aug. 4, 1994 | [JP] | Japan | 6-204326 |
| Aug. 23, 1994 | [JP] | Japan | 6-222562 |
| Aug. 25, 1994 | [JP] | Japan | 6-201088 |
| Sep. 1, 1994 | [JP] | Japan | 6-208898 |
| Dec. 21, 1994 | [JP] | Japan | 6-335620 |
| Apr. 5, 1995 | [JP] | Japan | 7-104768 |

[51] Int. Cl.[6] ..... B41J 2/45

[52] U.S. Cl. ..... 347/70; 347/40; 347/71

[58] Field of Search ..... 347/40, 70, 71, 347/92

[56] References Cited

U.S. PATENT DOCUMENTS

| | | | |
|---|---|---|---|
| 4,680,595 | 7/1987 | Cruz-Uribe et al. | 346/140 |
| 4,695,854 | 9/1987 | Cruz-Uribe | 340/140 R |
| 4,730,197 | 3/1988 | Raman et al. | 347/40 |
| 5,155,498 | 10/1992 | Roy et al. | 347/11 |
| 5,495,270 | 2/1996 | Burr et al. | 347/70 |

FOREIGN PATENT DOCUMENTS

| | | |
|---|---|---|
| 0 572 231 A2 | 12/1993 | European Pat. Off. . |
| 0573 256 A2 | 12/1993 | European Pat. Off. . |
| 0 584 823 A1 | 3/1994 | European Pat. Off. . |
| 6-40030 | 2/1994 | Japan . |

OTHER PUBLICATIONS

European Search Report.

*Primary Examiner*—Daniel P. Malley

*Attorney, Agent, or Firm*—Stroock & Stroock & Lavan LLP

[57] ABSTRACT

An ink supply communication path is formed so that one end thereof is arranged outside a region confronting a pressure producing chamber at a region confronting a reservoir chamber; and an ink supply constricted port is arranged at a portion of the ink supply communication path, the portion being remotest from the pressure producing chamber. Since the pressure producing chamber is connected to the ink supply constricted port through the elongated ink supply communication path, a jet flow from the ink supply constricted port grows into a large flow along the ink supply communication path, which in turn allows air bubbles susceptible to stagnation in the vicinity of the ink supply constricted port to be discharged by such large flow.

14 Claims, 12 Drawing Sheets

INK JET RECORDING HEAD

BACKGROUND OF THE INVENTION

1. Field of the Art

The present invention relates to an on-demand ink jet recording head that splashes an ink droplet upon receipt of an input of printing data and forms a dot on recording paper with this ink droplet. More specifically, the invention is directed to an ink jet recording head formed by bonding a thin strip of piezoelectric vibration element that vibrates in flexing mode onto a part of a pressure producing chamber communicating with a nozzle, and producing an ink droplet by causing the piezoelectric vibration element to contract the pressure producing chamber, the ink jet recording head being formed by integrally laminating a seal plate, a pressure producing chamber forming member, and a resilient plate.

2. Related Art

An on-demand ink jet recording head that outputs characters and graphics by jetting ink droplets out of a plurality of nozzles in correspondence to data outputted from an external device is advantageous in reducing noise and running cost, and can make a high quality recording on ordinary paper and recycled paper.

Generally, this ink jet recording head comes in two types. One is a so-called bubble jet type utilizing thermal energy produced by a heater, and the other is a piezoelectric vibration element drive type utilizing displacement of a piezoelectric vibration element. The latter is further categorized into two types: one utilizing vertical vibration of a piezoelectric vibration element and the other utilizing flexural vibration of a platelike piezoelectric vibration element.

A recording head utilizing vertical vibration is advantageous in decreasing an interval between nozzle arrays because the area of abutment between piezoelectric vibration elements and the resilient plate can be made small, but is also disadvantageous in making the assembling process complicated.

In contradistinction thereto, a recording head utilizing flexural vibration is advantageous in simplifying the assembling process because plate members for forming the piezoelectric vibration elements and other flow paths can be laminated, but is also disadvantageous in addressing the problem that the sectional area of a flow path is large and that a pool of ink is produced at the flow path and allows air bubbles and the like to stagnate because the size of the piezoelectric vibration element is larger than that in the recording head utilizing vertical vibration.

As disclosed, e.g., in Unexamined Japanese Patent Publication No. Hei. 6-40030, such ink jet recording head is formed by laminating a plurality of boards having different functions one upon another. An actuator unit having pressure producing chambers for producing pressure necessary for jetting ink droplets is formed of a pressure producing chamber forming plate, a resilient plate, and a seal plate, the resilient plate sealing one surface of the pressure producing chamber forming plate and the seal plate sealing the other surface of the pressure producing chamber forming plate. The pressure producing chamber forming plate defines slender pressure producing chambers arranged on a flat surface. The resilient plate has piezoelectric vibration elements so as to correspond to the pressure producing chambers. The seal plate has communication flow paths.

A flow path unit is formed of an ink supply constricted port forming plate having ink supply constricted ports and an ink reservoir chamber forming plate having an ink reservoir chamber, and a nozzle plate having nozzles. These two units are laminated to form a recording head so that the ink within the reservoir chamber is supplied to the pressure producing chambers through the ink supply constricted ports and the ink within the pressure producing chambers is jetted out of the nozzles.

The ink jet recording head of this structure not only is easy to manufacture because the head is formed by laminating the plurality of plates, but also enjoys high sealability and reliability of the ink flow paths between the bonded members because the actuator portion, in particular, is formed by integrally sintering a ceramic material. Hence, an ink jet recording head that is highly suitable for mass-production and highly reliable can be implemented.

However, since the sectional area of each flow path in the actuator made of ceramic is large in comparison with a small amount of ink consumed by the jetting of an ink droplet, the recording head of this structure is more susceptible to stagnation of ink or forming a pool of ink within the ink flow paths compared with the recording head utilizing piezoelectric vibration elements of vertical mode. This imposes the problem of causing air bubbles to stagnate therein.

The presence of air bubbles along the flow paths as described above blocks the ink from being supplied to the pressure producing chamber, reduces ink jetting performance by sucking pressure produced for jetting the ink, or brings about like inconvenience.

These air bubbles are produced for the following reasons. Air bubbles remain within the ink flow paths when the ink is charged to the recording head from an ink tank for the first time, infiltrate from a connecting portion to the ink tank when the ink tank is replaced with a new one to replenish the ink, or are produced as a result of the meniscus of ink in the nozzle being broken due to vibration or the like during printing.

One method of discharging the air bubbles from the recording head is to incorporate a pump within a boxlike body of an ink jet recording apparatus. That is, when the ink tank is replaced with a new one or when ink jetting abnormality occurs, the pump is driven to apply negative pressure to the nozzle to force the ink out. This method can discharge the air bubbles from the nozzle by causing the air bubbles to ride on a larger stream than a jet of ink droplet for printing.

However, even with such forcible discharge of the ink, it is still extremely difficult to eliminate air bubbles out of a region where the ink is jetted into the pressure producing chamber from the narrow opening of an ink supply constricted port because a vortex is produced as a result of an intense stream of ink during the forcible discharging of ink and such vortex picks the air bubbles up at such region or because a pool of ink is produced at such region. In addition, the amount of ink consumed is increased, which in turn raises the running cost of the apparatus.

SUMMARY OF THE INVENTION

An object of the invention is therefore to provide an ink jet recording head that can reduce stagnation of air bubbles within the ink flow paths as much as possible.

Another object of the invention is to provide an ink jet recording head that can reliably eliminate air bubbles within the flow paths, simplify the manufacturing process, and improve yield independently of the stepped portions produced due to inaccurate positioning in laminating the plates during the manufacturing process.

Still another object of the invention is to provide an ink jet recording head that has a connecting structure for reliably supplying the ink from an external source to the ink jet recording head.

An ink jet recording head, which is a preferred embodiment of the invention, is integrally formed by sequentially laminating:

a resilient plate for forming a vibration member having piezoelectric vibration elements on a surface thereof;

a pressure producing chamber forming plate for forming pressure producing chambers with a surface thereof sealed by the resilient plate;

a seal plate sealing other surface of the pressure producing chamber forming plate and having communication paths and ink supply communication paths, a communication path and an ink supply communication path communicating with the corresponding pressure producing chamber at both end portions of the pressure producing chamber;

an ink supply constricted port forming plate having first ink supply constricted ports for imparting fluid resistance to ink supply paths to the pressure producing chambers and having communication paths communicating with the pressure producing chambers;

a reservoir chamber forming plate having a reservoir chamber communicating with the pressure producing chambers through the ink supply constricted ports and communication paths communicating with the pressure producing chambers; and a nozzle plate sealing other surface of the reservoir chamber forming plate and having nozzles connected to the pressure producing chambers through the communication paths.

In such recording head, each ink supply communication path is formed so that one end thereof is arranged outside a region confronting the pressure producing chamber at a region confronting the reservoir chamber; and each first ink supply constricted port is positioned at a portion of the ink supply communication path, the portion being remotest from the pressure producing chamber.

Since the pressure producing chamber and the ink supply constricted port are connected to each other through the slender ink supply communication path, a jet flow of ink from the ink supply constricted port grows into a large flow so that air bubbles susceptible to stagnation in the vicinity of the ink supply constricted port can be discharged. In addition, such large flow can eliminate the air bubbles even if stepped portions are present in the ink supply communication path. That is, the air bubbles can be discharged even if stepped portions are produced due to manufacturing errors.

DETAILED DESCRIPTION OF THE PREFERRED EMBODIMENTS

Figure 1:
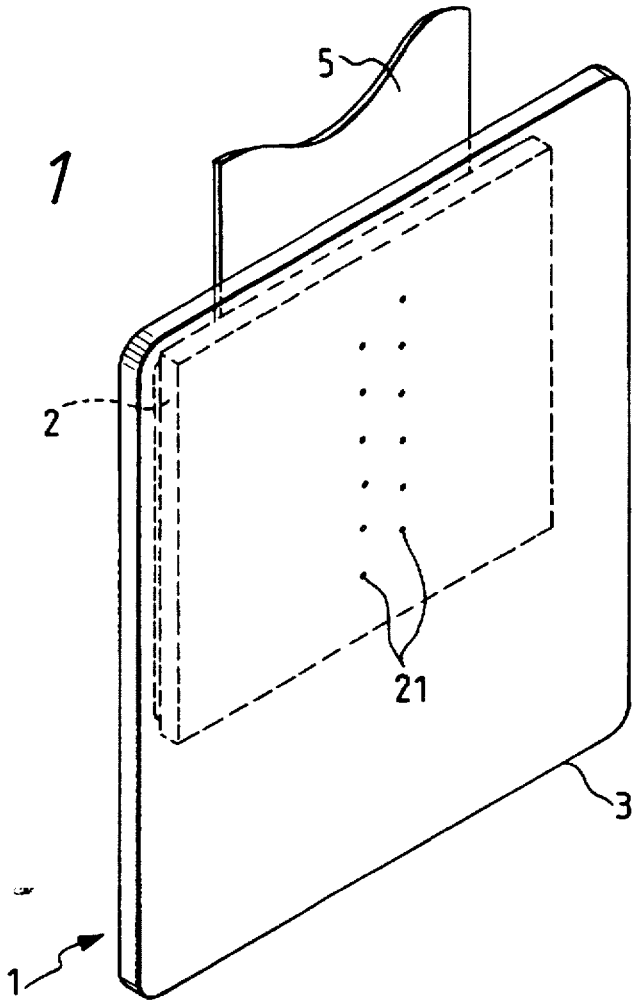
FIG. 1 is a perspective view showing the appearance of a head unit 1, which is a main portion of an ink jet recording head of the invention, the view being taken from the side of nozzles.
Figure 2:
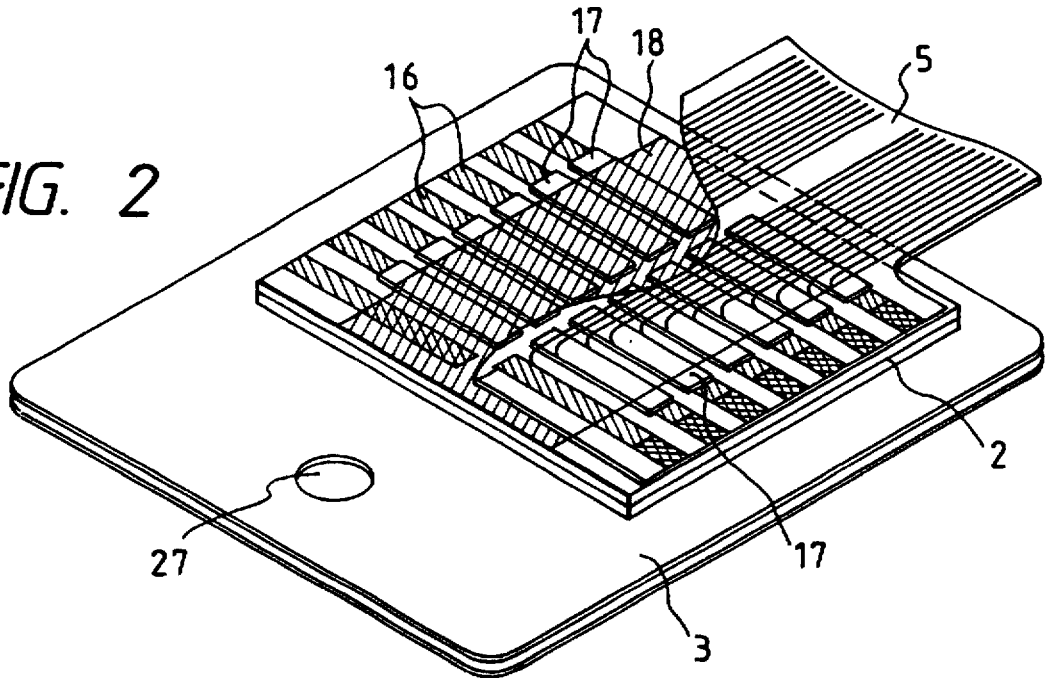
FIG. 2 is a perspective view showing the appearance of the head unit 1 shown in FIG. 1, the view being taken from the back of the head unit 1.

FIGS. 1 and 2 show an ink jet recording head, which is an embodiment of the invention. A head unit 1 is formed by laminating a platelike actuator unit 2 and a similarly platelike flow path unit 3 having a sufficient area for mounting the actuator unit 2 on a surface thereof. On a surface of the actuator unit 2 is a flexible cable 5 for applying a drive signal to a piezoelectric vibration element.

The actuator unit 2 is formed by sequentially laminating a seal plate 11, a pressure producing chamber forming plate 12, and a resilient plate 13. Lower electrodes 16 respectively corresponding to pressure producing chambers 15 are formed on the resilient plate 13, and piezoelectric vibration elements 17 are formed on the lower electrodes 16 so as to correspond respectively to the pressure producing chambers 15. On the upper surface of the piezoelectric vibration elements 17 is an upper electrode 18. Therefore, an individual drive signal for selectively driving a piezoelectric vibration element 17 is applied to one of the electrodes, e.g., to the lower electrode 16, and the other electrode, the upper electrode 18 in this embodiment, functions as a common electrode so that the piezoelectric vibration element 17 at a predetermined position can be driven to vibrate in flexure.

The lower electrodes 16 are connected to a flexible printed board (FPC) 5 through connecting terminals 19 formed at an end so that the lower electrodes are connected to a not shown external drive circuit. The pressure producing chambers 15 for producing ink pressure necessary for jetting ink droplets are formed by providing arrays of slender through holes in the surface of the pressure producing chamber forming plate 12. The seal plate 11 functions as the bottom plate for sealing one surface of the pressure producing chambers 15.

This seal plate 11 has nozzle communication paths 20 and slender ink supply communication paths 22 formed therein. Each nozzle communication path 20 is connected to a corresponding nozzle 21 for jetting an ink droplet, and each ink supply communication path 22 introduces the ink supplied from an external source to a corresponding pressure producing chamber 15. Each pressure producing chamber 15 is connected to the ink supply communication path 22 in the vicinity of a respective one end 15*a* thereof and to the nozzle communication path 20 at the respective other end 15*b* thereof.

On the other hand, the flow path unit 3 is formed by sequentially laminating a nozzle plate 30, a reservoir chamber forming plate 23, and an ink supply constricted port forming plate 24. The reservoir chamber forming plate 23 has a through hole for defining a reservoir chamber 25. The reservoir chamber forming plate 23 has the reservoir chamber 25 defined by causing one surface thereof sealed by the nozzle plate 30 and the other surface by the ink supply constricted port forming plate 24. The reservoir chamber 23 functions as the manifold for distributing the ink supplied from the external source through an ink supply port 27 into the respective pressure producing chambers 15.

Ink supply constricted ports 26 are formed in the ink supply constricted port forming plate 24. Each ink supply constricted port 26 connects the reservoir chamber 25 to one end of each ink supply communication path 22. The ink supply port 27 that introduces the ink from a not shown ink tank into the reservoir chamber 25 is arranged at a portion on the ink supply constricted port forming plate 24 surface not overlapping the actuator unit 2 on the surface.

The nozzles 21, 21 for jetting ink droplets are formed in the nozzle plate 30 so as to correspond to the pressure producing chambers 15. Nozzle communication paths 28, 29 are formed in the ink supply constricted port forming plate 24 and the reservoir chamber forming plate 23, respectively, so as to correspond to the nozzles 21 so that each nozzle 21 and the corresponding pressure producing chamber 15 can be connected to each other.

In this embodiment, one actuator unit 2 has two confronting arrays of pressure producing chambers 15. The pressure producing chambers in one array are staggered by half the arraying interval with respect to the pressure producing chambers in the other array along the length of the arrays. At the same time, the nozzles 21, 21 in such two arrays as to correspond to the arrays of the pressure producing chambers 15 are staggered by half the nozzle arraying interval with each other. As a result, the nozzle pitch as viewed from the sheet forwarding direction is equal to half the pressure producing chamber pitch, thereby making the printed dot density twice the nozzle arrangement density.

Both the ink supply constricted ports 26 and the nozzle communication paths 28 opened onto one surface of the flow path unit 3 are formed so as to be positioned to overlap the ink supply communication paths 22 and the nozzle communication paths 20 of the actuator unit 2 one by one, so that a flow path can be formed between both units 2, 3 by bonding the actuator unit 2 onto the flow path unit 3 by overlapping the former on the latter.

A specific example 40 of the aforementioned flow path unit will be described next.

The nozzle plate 30 made of a stainless steel sheet whose thickness ranges from 50 to 150 μm has two arrays of nozzles 21 formed therein in such a manner that the nozzles 21 in each array are pitched at an interval of 256 μm. Each nozzle 21 is a tapered opening whose diameter ranges from 30 to 50 μm. The reservoir chamber forming plate 23 has the through hole for defining the reservoir chamber 25 and the nozzle communication holes 29 formed therein by pressworking a stainless steel sheet whose thickness ranges from 100 to 150 μm. It may be noted that the diameter of the nozzle communication hole 29 is preferably set to the thickness of the steel sheet, or about 150 μm.

The ink supply constricted port forming plate 24 has the ink supply constricted ports 26 and the nozzle communication through holes 28 formed therein by pressworking a stainless steel sheet whose thickness ranges from 50 to 150 μm. Each ink supply constricted port 26 has fluid impedance thereof set to a value equal or larger than fluid impedance of the nozzle 21 so that an ink stream produced by the pressure of the pressure producing chamber 15 is directed toward the nozzle 21 by checking the ink stream from running away toward the reservoir chamber 25.

In this embodiment, the size of the ink supply constricted port 26 is set to the same value as that of the nozzle 21, and is tapered in the thickness direction as viewed in cross section. The tapered port gives the advantage of not only making the smallest portion of the diameter smaller than the thickness but also forming the port with satisfactory accuracy. The diameter of the nozzle communication through hole 28, which is larger than that of the nozzle communication hole 29 of the reservoir chamber forming plate 23 and smaller than the width of the pressure producing chamber 15, ranges from 200 to 300 μm. As a result of these settings, the flow path from the pressure producing chamber 15 to the nozzle 21 can be constricted so that the nozzle side of the flow path is made narrower to thereby prevent bubbles from stagnating within the flow path.

These three plates 24, 23, 30 forming the flow path unit 3 are bonded to one another in laminated form so that the through holes related to one another can communicate with one another in this embodiment. An adhesive made of epoxy resin that is not corroded by the ink is used for the bonding in this embodiment. Brazing and soldering, diffusion welding, adhesive bonding, bonding with a blanked adhesive sheet, or the like may also be employed.

While these plates are made of stainless steel, any materials may be selected so that the materials appropriately match the functions of the plates in combination, as long as such material is not corroded by the ink. For example, such inorganic materials as ceramics, glass, and silicon, metals such as nickel, and plastic materials such as polyimides, polycarbonates, or polysulfones.

The holes may be formed by subjecting plastic plates to a laser beam machining process using excimer laser or to an electroforming process using nickel since the nozzle plate 30 and the ink supply constricted port forming plate 24 are relatively thin and must have accurately formed small diameter holes.

In this embodiment, the flow path unit 3, serving also as the actuator unit 2 fixing plate, must be highly rigid. Therefore, a metal having both toughness and rigidity may be preferably used. The reservoir chamber forming plate 23, in particular, having the through hole whose diameter is larger than those of the other plates, is preferred to use a thicker plate than the other plates to ensure rigidity.

A specific example of the actuator unit 2 will be described next. The pressure producing chamber forming plate 12 is a zirconia ($ZrO_2$) sintered body whose thickness is 150 μm. A plurality of pressure producing chambers 15 are pitched at an interval of 564 μm in two arrays in the same manner as the nozzles 21. The width of each pressure producing chamber 15 ranges from 350 to 450 μm, and the length thereof ranges from 1 to 3 mm. These dimensions are appropriately selected so as to be optimal in consideration of the amount of ink droplet required for forming a dot and a nozzle arrangement density, and the like.

The seal plate 11 is a zirconia sintered body whose thickness is 150 μm, and is bonded to one surface of the pressure producing chamber forming plate 12 so as to seal such surface of the pressure producing chambers 15. The diameter of the communication path 20 communicating with the corresponding nozzle is set to about 300 μm.

The resilient plate 13 is a zirconia sintered body whose thickness ranges from 10 to 20 μm, and is bonded so as to seal the other surface of the pressure producing chambers 15. The lower electrodes 16 are formed on the resilient plate 13 so as to correspond to the pressure producing chambers 15. On the surfaces of the lower electrodes 16 are the piezoelectric vibration elements 17. The piezoelectric vibration elements 17 are formed by laminating strips, each strip being made of a piezoelectric ceramic material such as lead titanate zirconate and having a width that is 80 to 90% the width of the pressure producing chamber 15 and a thickness that ranges from 20 to 40 μm. It may be noted that other ceramic materials such as alumina, aluminum nitride, lead titanate zirconate may be used instead of zirconia.

A method of manufacturing the aforementioned actuator unit will be described next.

Figure 3:
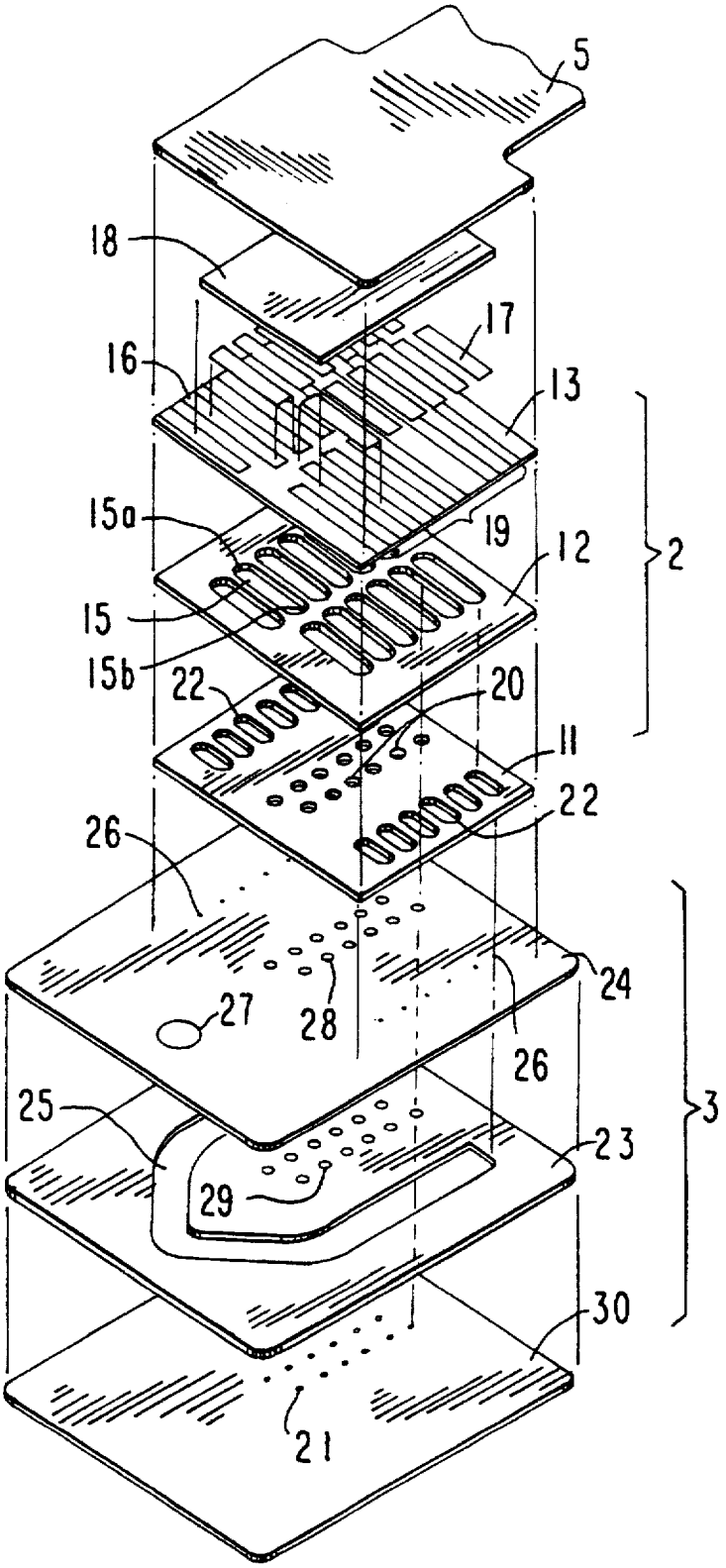
FIG. 3 is a perspective view showing the head unit shown in FIG. 1 in unassembled form.
Figure 4A:
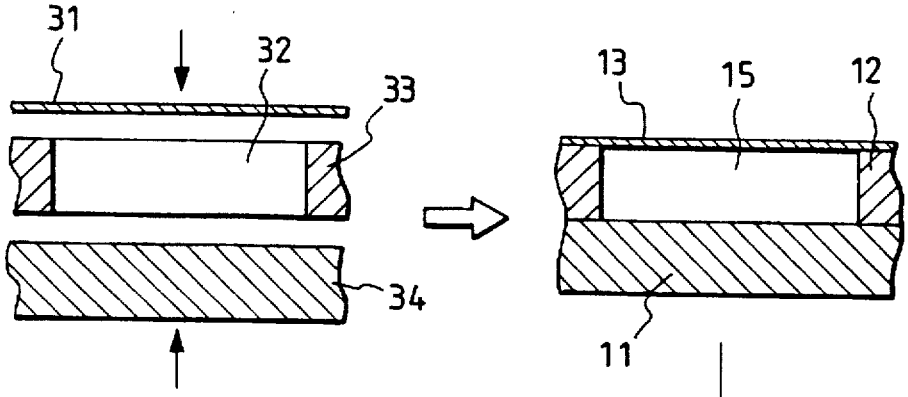
FIGS. 4(A) to (C) are diagrams illustrative of a process of manufacturing an actuator unit.

As shown in FIG. 4(A), a green sheet 31 that will be the resilient plate 13, a green sheet 33 that will be the pressure producing chamber forming plate 12 having through holes 32 defining the pressure producing chambers 15 blanked in advance by a press, and a green sheet 34 that will be the seal plate 11 having the communication holes 20, 22 (FIG. 3) blanked in advance by the press are bonded by pressure and sintered together at a temperature ranging from 800° to 1000° C. As a result of this process, the resilient plate 13, the pressure producing chamber forming plate 12, and the seal plate 11 are bonded together without an adhesive.

Figure 4B:
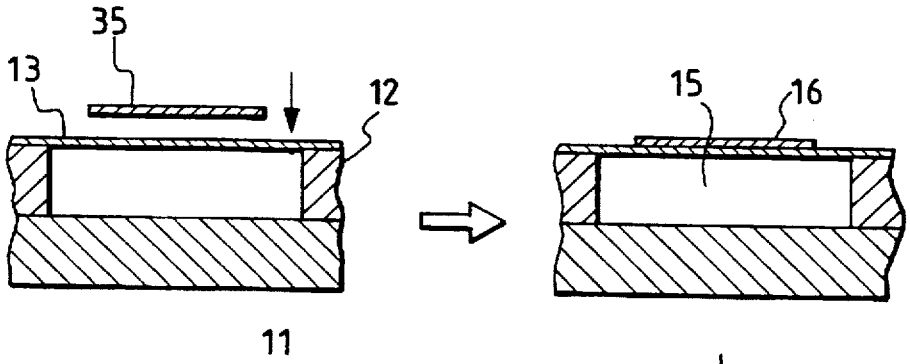

As shown in FIG. 4(B), a lower electrode pattern 35 is formed by printing a material onto a portion corresponding to the pressure producing chamber 15, the material having at least one kind selected from the group consisting of platinum, palladium, and alloys such as silver-palladium, silver-platinum, and platinum-palladium as the main composition thereof. The thus processed body is sintered.

Figure 4C:
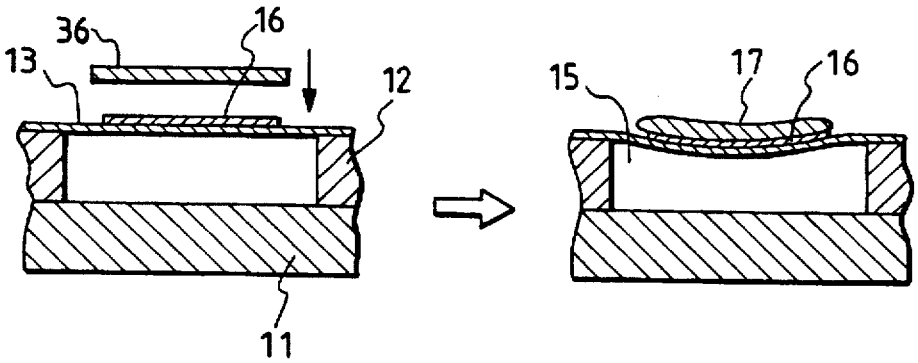
Figure 5:
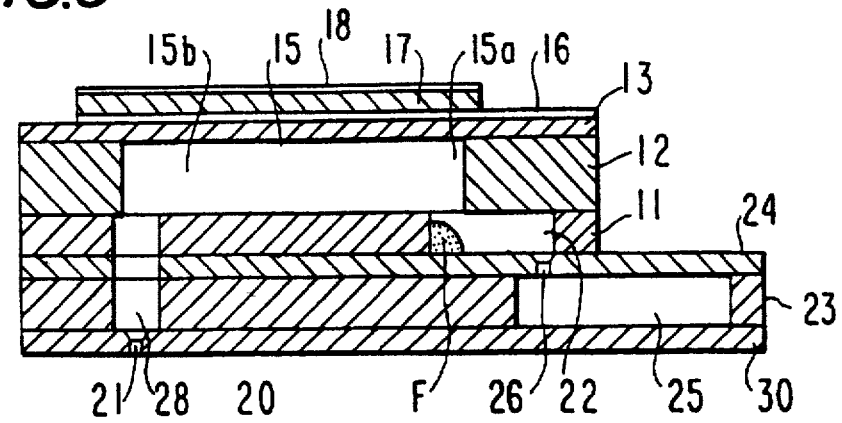
FIG. 5 is a sectional view showing a head unit, which is an embodiment of the invention.

As shown in FIG. 4(C), a piezoelectric material 36 that will be the piezoelectric vibration element 17 is thereafter laminated thereon by printing and sintered to complete the preparation of the actuator unit 2. As the final step, the common electrode 18 made of chromium, gold, nickel, copper, or the like is formed by sputtering so as to extend over the plurality of piezoelectric vibration elements 17.

The actuator unit thus formed by integral sintering has the pressure producing chamber forming plate 12 having very subtle structure and the resilient plate 13 and the seal plate 11 being thin bonded one another strongly by sintering. Therefore, the actuator unit has excellent airtightness and corrosion resistance against ink. In addition, the manufacturing process is extremely simple and provides satisfactory accuracy because what is required is only to laminate the clay plates, apply the pastelike materials for forming the electrodes and the piezoelectric vibration elements by printing, and sinter the thus processed body.

While the aforementioned method of forming the actuator unit by integral sintering is excellent, it goes without saying that the actuator unit may be formed by combining conventional methods such as a method of bonding plates made of metal or resin by adhesion, welding, or fusion, a method of etching plates made of glass or silicon, a method of plastic molding, and a method of mounting chipped piezoelectric vibration elements on a vibration plate.

The flow path design in the flow path unit 3 and the actuator unit 2 will be described next with reference to FIGS. 6 and 7.

The ink in the external ink tank flows into a pressure producing chamber 15 via the ink supply port 27, the reservoir chamber 25, the corresponding ink supply constricted port 26, and the corresponding ink supply communication path 22. Such ink stream heading toward the pressure producing chamber 15 is produced by applying negative pressure, e.g., with a pump by bringing a cap member into resilient contact with the nozzle plate 30 in order to charge the ink for the first time and to discharge not only air bubbles and bubbles stagnant in the flow paths but also degenerated ink whose viscosity has been increased after being charged.

On the other hand, if the ink has been consumed due to printing, the ink stream is produced in response to the application of voltage to a corresponding piezoelectric vibration element 17. That is, the piezoelectric vibration element 17 contracts inward and the resilient plate 13 is deformed by flexing in such a direction as to contract the corresponding pressure producing chamber 15. The fluid pressure produced at this instance causes an ink droplet to be jetted out of the corresponding nozzle 21 via the nozzle communication paths 20, 28 from the pressure producing chamber 15, and when the pressure producing chamber 15 returns to expand due to the removal of the signal, the ink is introduced into the pressure producing chamber 15 via the corresponding ink supply constricted port 26 from the reservoir chamber 25.

Figure 6:
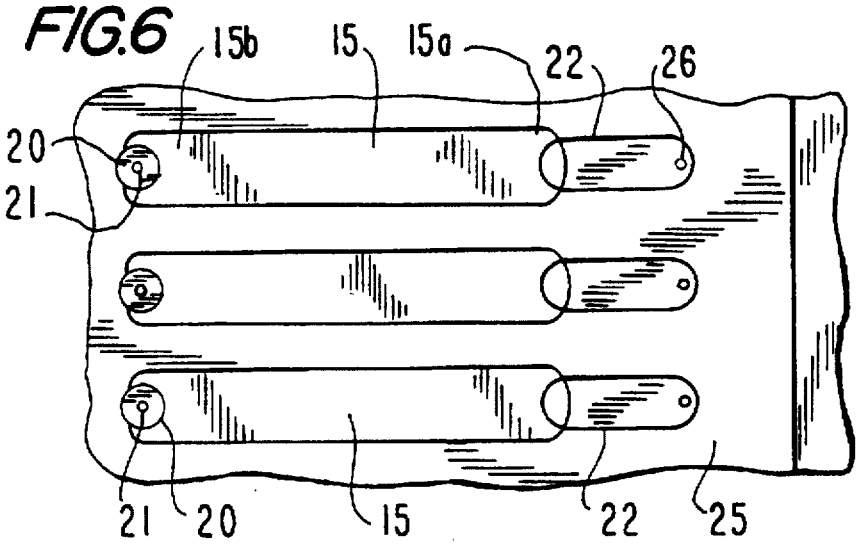
FIG. 6 is a plan view showing how a reservoir chamber and pressure producing chambers are connected.
Figure 7:
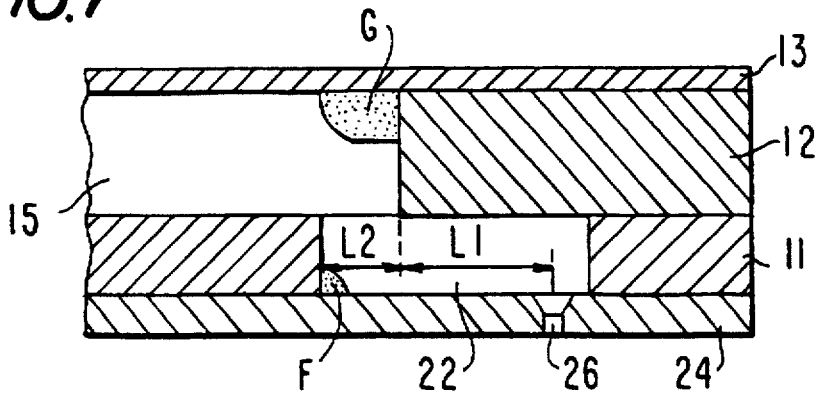
FIG. 7 is a diagram illustrative of an optimal size of an ink supply communication path.

By the way, the ink supply constricted port 26 is arranged outside each corresponding pressure producing chamber 15 as viewed in the longitudinal direction of the pressure producing chamber as shown in FIGS. 6 and 7 in such a manner as to be opened onto the lower wall of one end of the slender ink supply communication path 22. As a result of this structure, when the ink is forcibly discharged by applying negative pressure to the nozzle 21, a jet flow produced at the ink supply communication path 22 by the ink supply constricted port 26 once collides with the upper wall of the ink supply communication path 22 confronting the ink supply constricted port 26, i.e., with the pressure producing chamber forming plate 12, flows along the length of the ink supply communication path 22, and finally flows into the pressure producing chamber 15 by changing the direction thereof upward at the other end of the ink supply communication path 22, i.e., at the connecting part with the pressure producing chamber 15.

Hence, the jet flow of ink flows along the ink supply communication path 22 while converted into a large stream, thereby allowing the ink stream to change the direction smoothly without producing a vortex and therefore allowing air bubbles to be discharged riding on such large flow of ink.

However, air bubbles are likely to stagnate at an end portion F of the ink supply communication path 22 on the side of the pressure producing chamber 15, depending on the length of the ink supply communication path 22. In view of this fact, the presence of air bubbles at the end portion F is checked by changing the lengths L1, L2 of the ink supply communication path 22 as shown in FIG. 7. It may be noted that the resilient plate 13 is formed by a transparent plate such as a glass plate to make the presence of air bubbles visibly observable.

The dimensions of the ink supply constricted port 26 are as follows. The diameter of the smallest portion of the ink supply constricted port 26 is 30 μm; the length of the cylindrical portion is 20 μm; the tapering angle of the tapered portion is 35° in total angle; and the total length of the ink supply constricted port 26 (the thickness of the plate) is 60 μm. Further, the dimensions of the ink supply communication path 22 are as follows. The length is 200 μm; and the height (the thickness of the plate+the thickness of the adhesive) is 180 μm.

Whether or not the air bubbles can be discharged was visibly checked while applying negative pressure to the nozzle 21 with air bubbles charged into the ink supply communication path 22.

TABLE 1

| | L1 (μm) | L2 (μm) | Discharged air bubble condition |
|---|---|---|---|
| Example 1 | 100 | 100 | x |
| Example 2 | 100 | 150 | x |
| Example 3 | 150 | 100 | Δ |
| Example 4 | 150 | 150 | Δ |
| Example 5 | 200 | 100 | o |
| Example 6 | 200 | 150 | o |
| Example 7 | 330 | 100 | o |
| Example 8 | 330 | 150 | o |

It may be noted that the symbol "x" indicates that the air bubbles were not discharged; the symbol "A" indicates that part of the air bubbles were discharged; and the symbol "o" indicates that the air bubbles were discharged completely.

From the above results, it was verified that the length L1 between the ink supply constricted port 26 and the wall surface of the pressure producing chamber 15 is important and that if the length L1 is equal to or larger than the sectional dimension (180 μm) of the ink supply communication path 22, the stream of ink in the ink supply communication path 22 does not deviate toward the pressure producing chamber forming plate 12 and the like and therefore flow uniformly along the entire part of the communication path 22 to thereby discharge the air bubbles.

Figure 8:
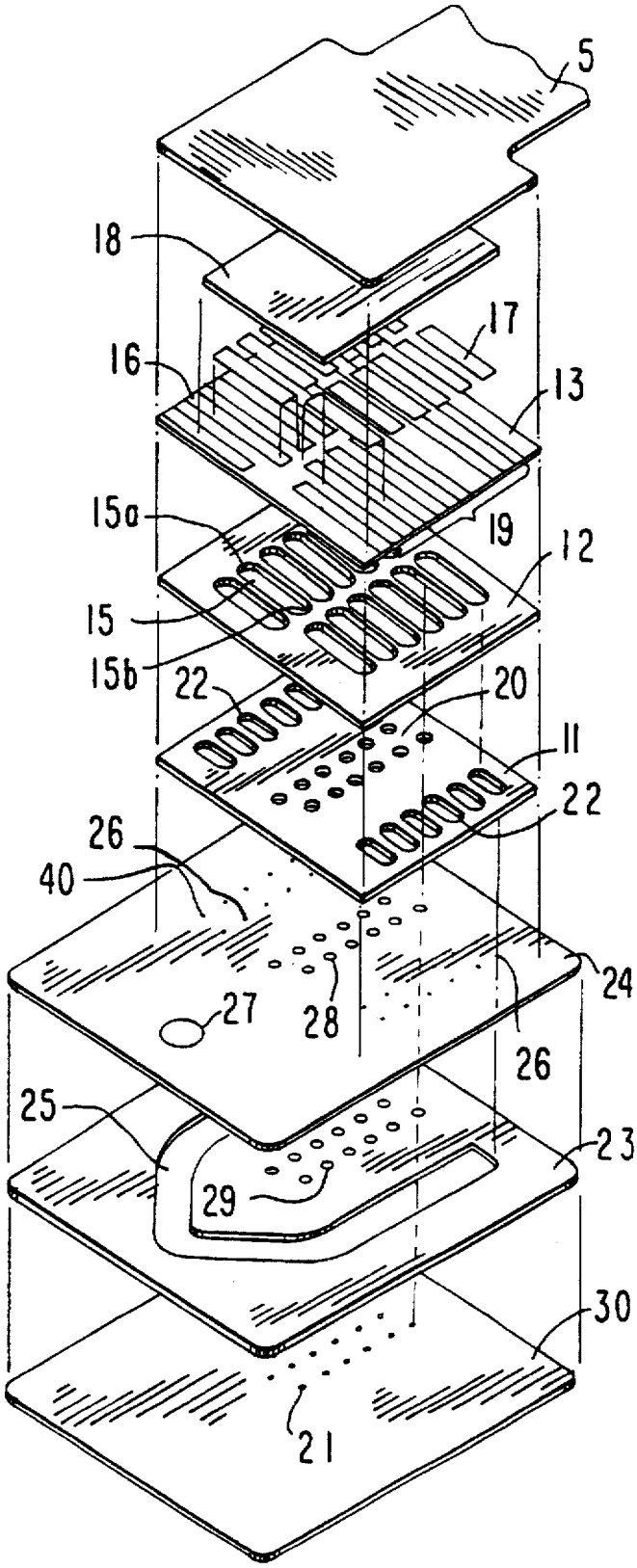
FIG. 8 is a perspective view of a head unit, which is another embodiment of the invention, in unassembled form.
Figure 9:
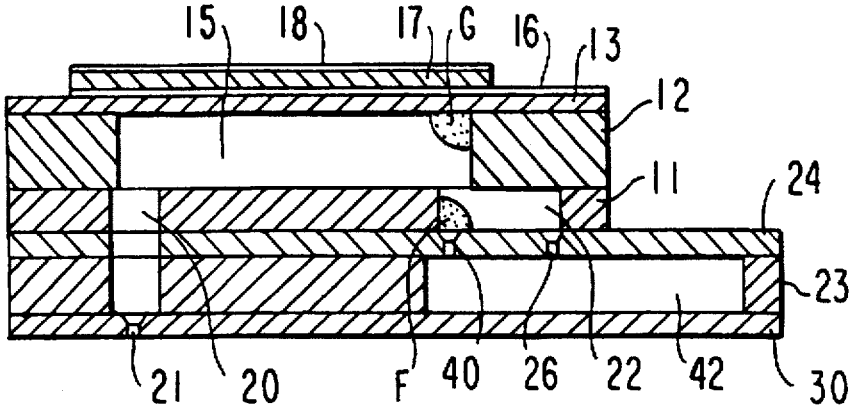
FIG. 9 is a sectional view of the head unit shown in FIG. 8.
Figure 10:
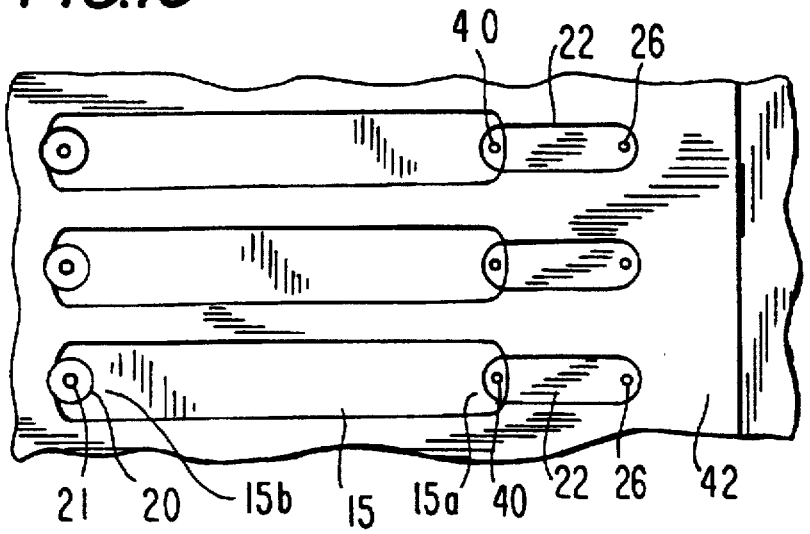
FIG. 10 is a plan view showing a relationship between a reservoir chamber and pressure producing chambers in the head unit shown in FIG. 8.

FIGS. 8, 9, and 10 show a second embodiment of the invention. In this embodiment, the ink supply constricted port forming plate 24 has second ink supply constricted ports 40 close to the pressure producing chambers 15 in addition to the aforementioned ink supply constricted ports 26 so that the ink supply communication paths 22 communicate with a reservoir chamber 42 at two positions.

Each ink supply constricted port 26 is arranged outside the corresponding pressure producing chamber 15 in the longitudinal direction of the pressure producing chamber 15 similarly to the aforementioned embodiment, and opened onto the lower wall of one end portion of the corresponding slender ink supply communication path 22. Each second ink supply constricted port 40 is positioned so as to be opened onto a portion at which the opening of the corresponding pressure producing chamber 15 overlaps that of the corresponding ink supply communication path 22 and at which both members 15 and 22 are connected to each other. The second ink supply constricted port 40 therefore confronts the end portion of the pressure producing chamber 15 while interposing the ink supply communication path 22 therebetween. By arranging the second ink supply constricted port 40, air bubbles stagnant at portions F and G shown in FIG. 9 can be discharged more easily. In addition, the ink stream in the reservoir chamber 42 is bifurcated into the two ink supply constricted ports 26, 40, and this makes the ink stream uniform within the reservoir chamber 42, thereby contributing to improving air bubble discharging performance within the ink reservoir chamber 42 and hence recovering the ink stream by discharging a smaller mount of air bubbles.

By the way, the ink supply constricted port 26 functions to introduce the ink into the nozzle 21 efficiently by restricting the pressure produced by the contraction of the pressure producing chamber 15 from escaping to the reservoir chamber 42 as described above. If two ink supply constricted ports are provided, the problem of having to increase piezoelectric vibration element 17 drive voltage and a like problem are addressed because the pressure produced at the pressure producing chamber 15 escapes to the reservoir chamber 42 to thereby reduce the stream of ink into the nozzle 21.

To overcome this problem, i.e., to discharge air bubbles efficiently without reducing the ink jetting performance, the amount of the ink incoming into and outgoing from the second ink supply constricted port 40 must be made smaller than that of the ink flowing into the pressure producing chamber 15 from the first ink supply constricted port 26. In other words, the strong ink stream at the second ink supply constricted port 40 disadvantageously produces a vortex at the connecting portion between the ink supply communication path 22 and the pressure producing chamber 15, and it is therefore necessary to make the fluid resistance of the second ink supply constricted port 40 larger than that of the first ink supply constricted port 26 so that the flowrate of ink at the second ink supply constricted port 40 becomes smaller than that at the first ink supply constricted port 26, preferably half that at the first ink supply constricted port 26.

The fluid resistance is inversely proportional substantially to the fourth power of the diameter of the smallest portion of each of the ink supply constricted ports 26, 40. Specifically, if the diameter of the smallest portion of the first ink supply constricted port 26 is 35 μm and the diameter of the smallest portion of the second ink supply constricted port 40 is 30 μm, then the ratio in flowrate of the former to the latter is 2 to 1. Further, since it is important that the production of a vortex be controlled in order to discharge air bubbles efficiently with a smaller flowrate of ink, it was found out to be effective to taper the second ink supply constricted part 40 toward the reservoir chamber 42.

Figure 11:
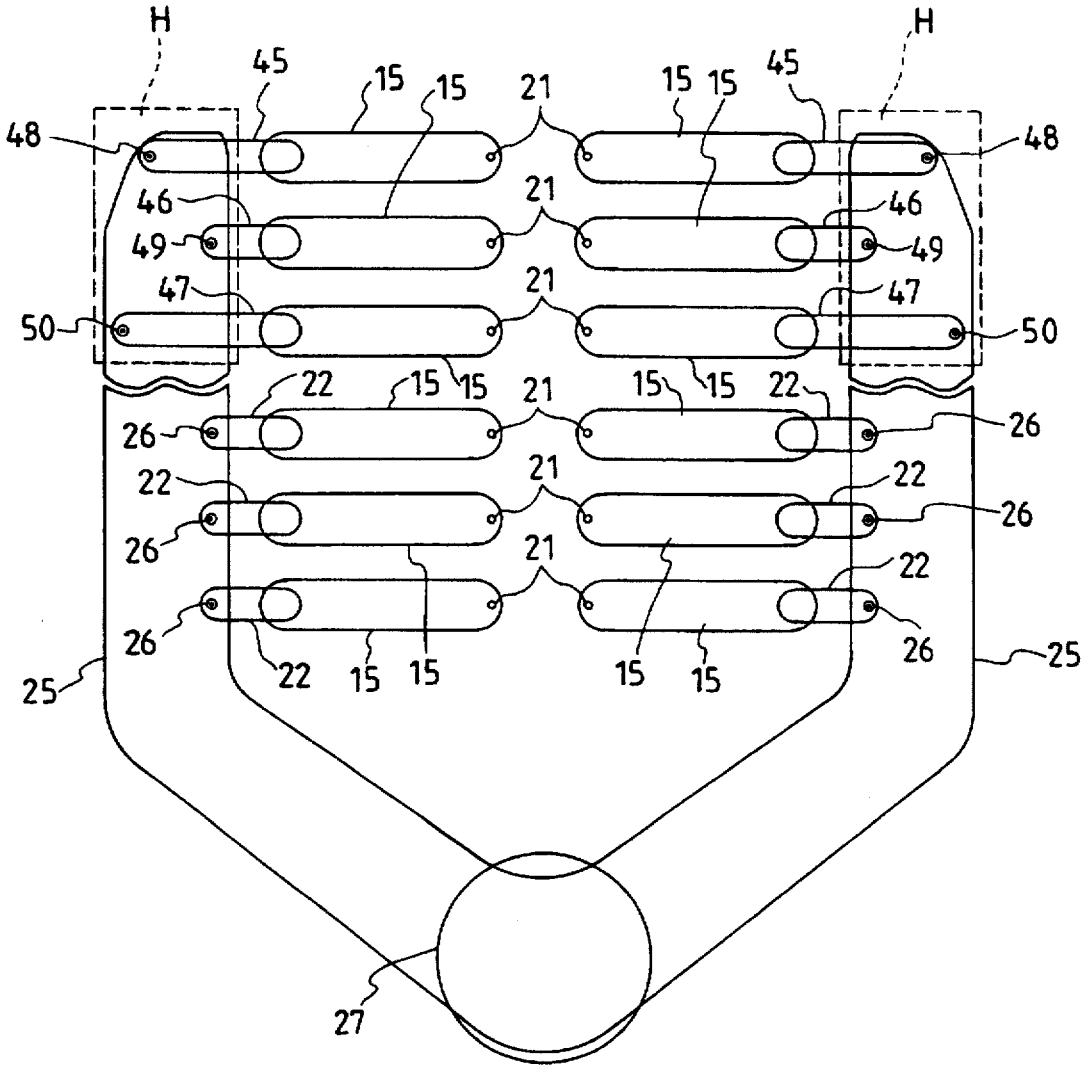
FIG. 11 is a plan view showing still another embodiment of the invention by way of a relationship between a reservoir chamber and pressure producing chambers.

FIG. 11 shows another embodiment of how the ink supply communication paths are arranged. A plurality of ink supply communication paths 45, 46, 47 positioned at the end regions H of the reservoir chamber 25 are extended in the width direction of the reservoir chamber 25 so that ink supply constricted ports 48, 49, 50 communicating with the reservoir chamber 25 can be staggered over the reservoir chamber 25.

According to this embodiment, the aforementioned advantage can be provided. That is, not only the stagnation of air bubbles within the communication paths 45, 46, 47 can be prevented, but also air bubbles within the reservoir chamber 25 can be discharged reliably by causing the ink to flow into the pressure producing chambers 15 uniformly from the end regions H in which the ink tends to stagnate.

Figure 12A:
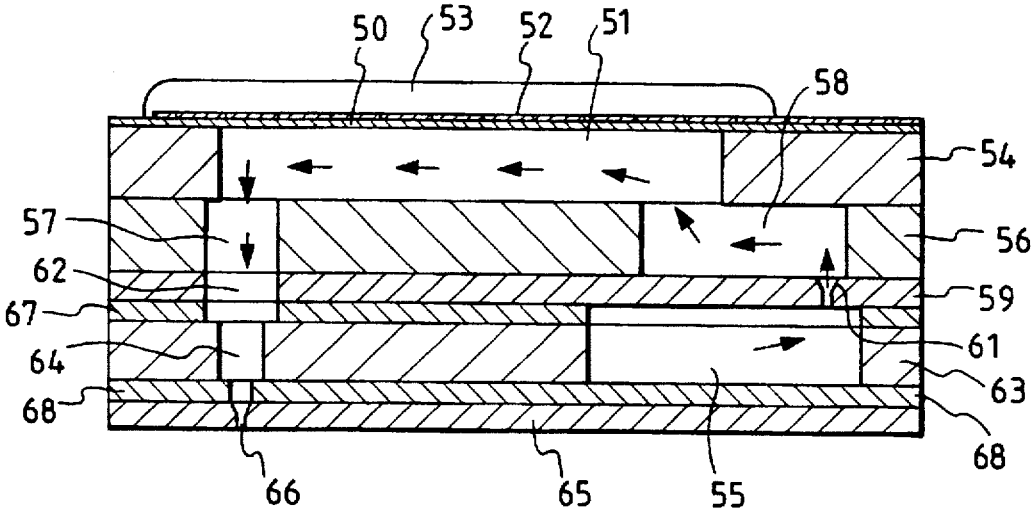
FIGS. 12(A) and (B) are sectional views showing still another embodiment of the invention in the form of sectional structures in the vicinity of a pressure producing chamber and of a dummy pressure producing chamber, respectively.
Figure 12B:
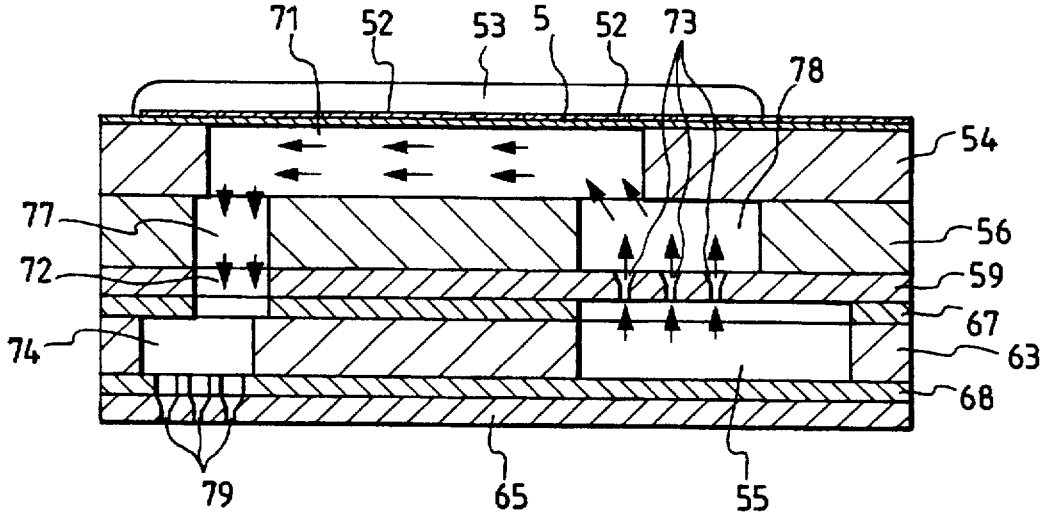
Figure 13:
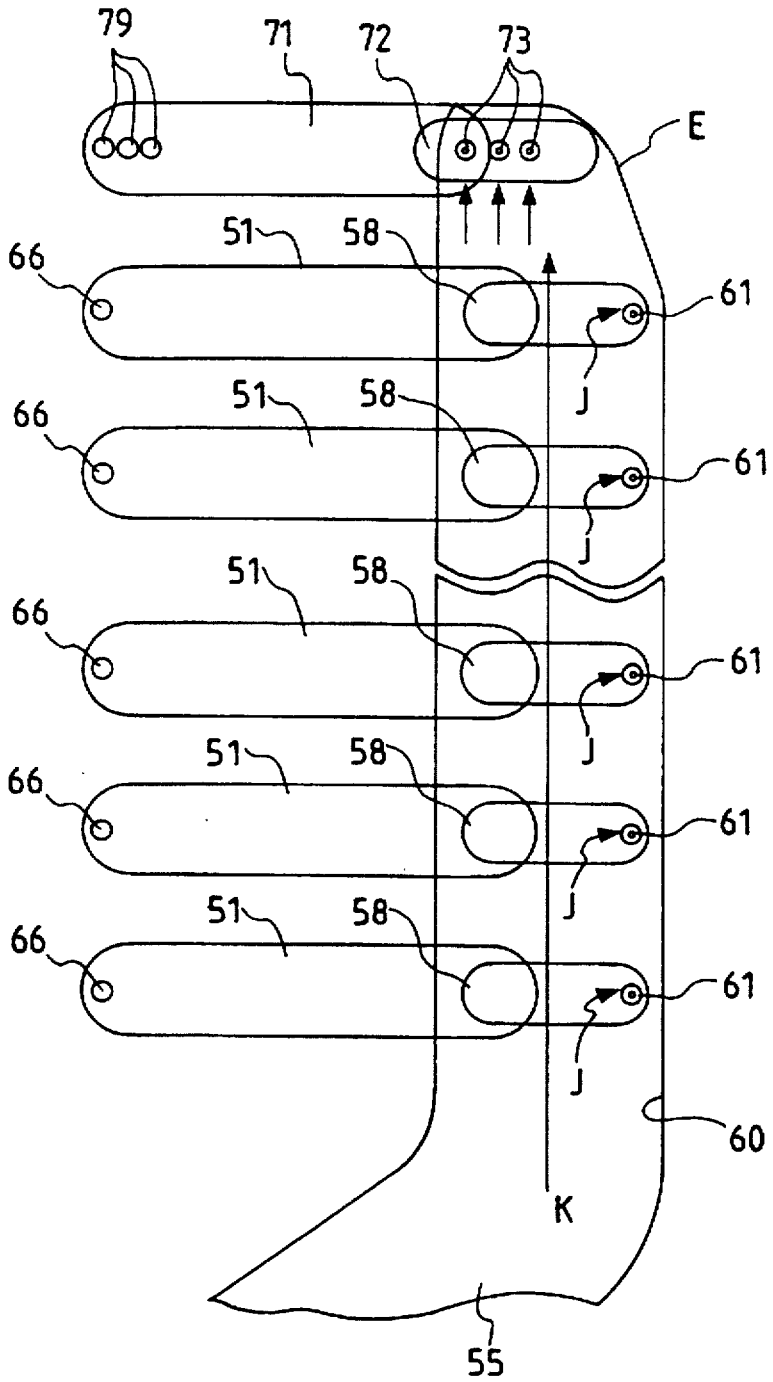
FIG. 13 is a plan view showing a relationship between a reservoir chamber and pressure producing chambers in the head unit shown in FIG. 12.

FIGS. 12(A) and (B) show a third embodiment of the invention. This embodiment is characterized as using pressure producing chambers 71 (see FIG. 13) located at both ends of a reservoir chamber 55 as dummy pressure producing chambers that have nothing to do with printing but are used only to discharge the ink from corresponding nozzles forcibly. FIGS. 12(A) shows a structure in the vicinity of an ordinary pressure producing chamber 51 for jetting an ink droplet for printing, and FIG. 12(B) shows a structure in the vicinity of the aforementioned dummy pressure producing chamber 71.

In FIGS. 12(A) and (B), reference numeral 50 denotes a resilient plate constructed in a manner similar to that in the aforementioned embodiments. Drive electrodes 52 are formed on a surface of a zirconia sheet whose thickness is about 10 μm so as to confront pressure producing chambers 51 (to be described later), and piezoelectric vibration elements 53 •••, each being made of PZT, are fixed thereon.

Reference numeral 54 denotes a pressure producing chamber forming plate, which has through holes pitched at a predetermined interval on a ceramic plate such as a zirconia plate having such a thickness as to form the pressure producing chambers 51, e.g., a thickness of 150 μm. Each through hole corresponds to the shape of the pressure producing chamber 51. The pressure producing chambers located at the endmost regions E of the reservoir chamber 55 are the dummy pressure producing chambers 71.

Reference numeral 56 denotes a seal plate for sealing the other surface of the pressure producing chambers 51 and the dummy pressure producing chambers 71. Communication paths 57, 77 that communicate the pressure producing chamber 51 and the dummy pressure producing chamber 71 with the nozzle(s) at the surface of the pressure producing chambers 51 and 71 confronting the nozzle(s) are formed, and slender ink supply communication paths 58, 78 that communicate with the pressure producing chamber 51 and the dummy pressure producing chamber 71 at the other end of the pressure producing chambers 51 and 71 are formed.

Each of the ink supply communication paths 58, 78 is such that: one end thereof communicates with the pressure producing chamber 51 or the dummy pressure producing chamber 71 in the vicinity of the wall surface of the pressure producing chamber 51 or the dummy pressure producing chamber 71 as described above; the other end thereof projects from the pressure producing chamber 51 or the dummy pressure producing chamber 71; and the width thereof is substantially equal to that of the pressure producing chamber 51 or the dummy pressure producing chamber 71 and the length thereof is about 1/10 that of the pressure producing chamber 51 or the dummy pressure producing chamber 71 so as to cause the incoming ink in the form of a jet flow to be introduced into the pressure producing chamber 51 or the dummy pressure producing chamber 71 in the form of a laminar flow at the other end.

Reference numeral 59 denotes an ink supply constricted port forming plate serving also as the unit fixing plate having the aforementioned actuator unit fixed at a predetermined position with an adhesive. The ink supply constricted port forming plate 59 has ink supply constricted ports 61 and communication paths 62. Each ink supply constricted port 61 is located below the ink supply communication path 58 so as to be remote from the pressure producing chamber 51 and in the vicinity of an outer wall surface 60 of the reservoir chamber 55. The ink supply constricted port 61 has a fluid resistance substantially the same as that of the nozzle. The ink supply constricted port 61 expands toward the ink supply communication path 58. Each communication path 62 communicates with the nozzle at a portion confronting the communication path 57.

On the other hand, at a portion of the plate 59 confronting each ink supply communication path 78 that communicates with the dummy pressure producing chamber 71 are a plurality of ink supply constricted ports 73, 73, 73. These ports 73, 73, 73 are arranged so as to be scattered around in the width direction of thee reservoir chamber 55 so that the total fluid resistance is made smaller than that of the ink supply constricted port 61 of the pressure producing chamber 51 and so that a stream is produced uniformly in the width direction of the endmost region E of the reservoir chamber 55. Further, a communication path 72 communicating with nozzles 79 is provided at a portion confronting each communication path 77.

Reference numeral 63 denotes a reservoir chamber forming plate. The reservoir chamber forming plate 63 is prepared by forming a window and communication holes 64, 74 in a corrosion-resistant plate such as a stainless steel plate having such a thickness as to form the reservoir chamber 55, e.g., a thickness of 150 μm. The window serves as the reservoir chamber 55 and the communication holes 64, 74 communicate with the nozzle(s).

Reference numeral 65 denotes a nozzle plate. The nozzle plate 65 has a single nozzle 66 that communicates with the corresponding pressure producing chamber 51 on a side close to the pressure producing chamber 51 and a plurality of nozzles 79, 79, 79 that communicate with a single dummy pressure producing chamber 71. The ink supply constricted port forming plate 59, the reservoir chamber forming plate 63, and the nozzle plate 65 are assembled into a flow path unit while fixed integrally through bonded layers 67, 68 such as thermally deposited films.

When a drive signal is applied to a piezoelectric vibration element 53 in this embodiment, the resilient plate 50 flexes so as to project toward the pressure producing chamber 51 to cause the pressure producing chamber 51 to contract. As a result, the ink within the pressure producing chamber 51 reaches the nozzle 66 via the through holes 57, 64 and is jetted out of the nozzle 66 in the form of an ink droplet. It may be noted that the ink will never be jetted out of the nozzles 79 since no drive signal is applied to the dummy pressure producing chambers 71.

When the drive signal is removed after the ink droplet has been formed, the piezoelectric vibration element 53 returns to the original position to cause the pressure producing chamber 51 to expand. As a result, as much ink as consumed by the formation of the ink droplet is introduced into the pressure producing chamber 51 via the ink supply constricted port 61 from the reservoir chamber 55. Printing is done by repeating this process thereafter.

On the other hand, if the ink jetting performance is impaired or if the ink tank is replaced with a new one, then air bubbles that have entered into the reservoir chamber 55 and the pressure producing chamber 51 due to clogging or during the replacement of the ink tank are eliminated by forcibly discharging the ink from the nozzles 66, 79 while biasing the cap member onto the nozzle plate 65 and applying negative pressure to the nozzle plate 65.

When the ink is forcibly discharged by applying negative pressure in this way, the ink supply constricted port 61 communicating with each pressure producing chamber 51, which is arranged adjacent to the wall surface 60 of the reservoir chamber 55, allows the ink close to the wall surface 60 to be introduced in a direction opposite to the wall surface 60 by adhesive viscous resistance.

Since one-sided streams J, J, J (see FIG. 13) are produced within the reservoir chamber 55 as a result of the above movement of the ink, air bubbles introduced into the reservoir chamber 55 and stagnant therein are carried to the pressure producing chambers 51 from the ink supply constricted ports 61 riding on these streams and discharged from the nozzles 66 to the outside.

Further, since the plurality of ink supply constricted ports 73 communicating with the dummy pressure producing chambers 71 are formed at the endmost regions E of the reservoir chamber 55 across the width of these regions, air bubbles enter into the dummy pressure producing chambers 71 without stagnation. At the same time, large streams K flowing along the length of the reservoir chamber 55 are also produced. As a result, air bubbles tending to stagnate at the endmost regions E of the reservoir chamber 55 are sucked into the dummy pressure producing chambers 71 and swiftly discharged from the plurality of nozzles.

A stream that synthesizes the stream heading toward each endmost region E and the streams heading toward the wall surface 60 is produced within the reservoir chamber 55. Therefore, all the air bubbles that have entered into the reservoir chamber 55 and are present at any portions of the reservoir chamber 55 are caused to flow into the pressure producing chambers 51 and the dummy pressure producing chamber 71 from the ink supply constricted ports 61, 73 by this synthesized stream and discharged from the nozzles 66, 79 to the outside.

Therefore, it is not necessary to constrict the endmost regions E of the reservoir chamber 55 in consideration of the discharging of air bubbles even if the width of the reservoir chamber 55 is increased, which therefore gives the reservoir chamber 55 such compliance as required for the jetting of an ink droplet.

Figure 14:
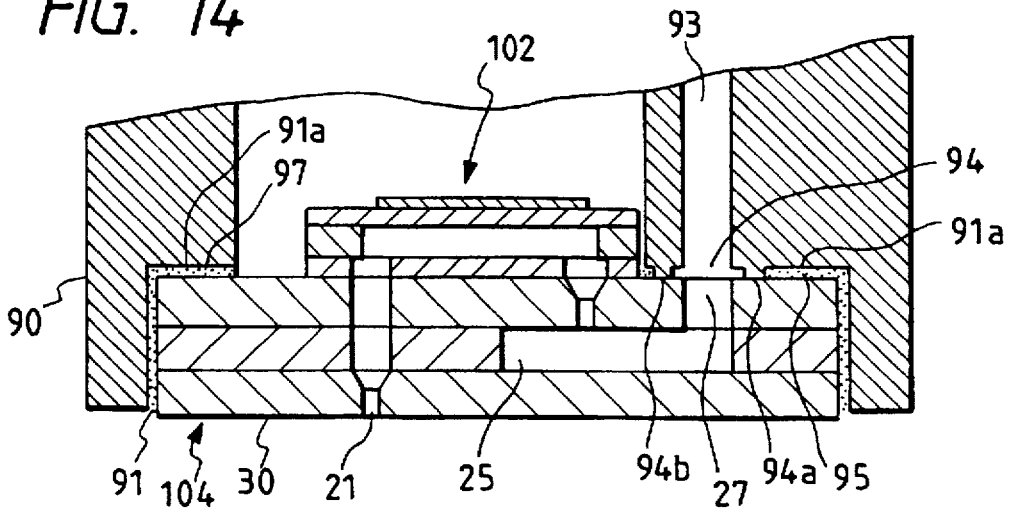
FIG. 14 is a sectional view showing a structure for attaching a head unit to a head holder.
Figure 18:
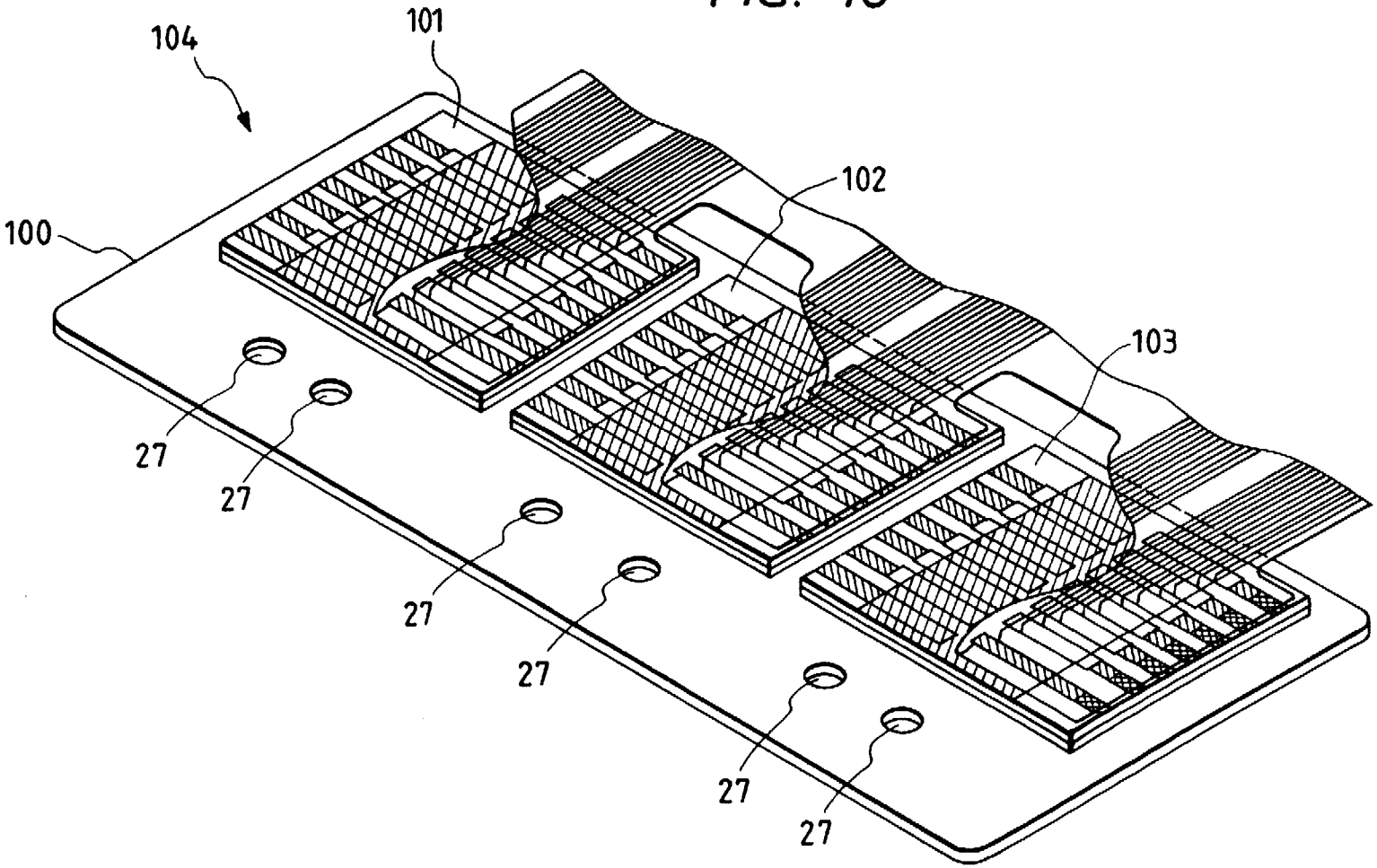
FIG. 18 is a perspective view showing a head unit, which is still another embodiment of the invention.

FIG. 14 shows an exemplary bonding structure for attaching the aforementioned head unit 1 to a head holder 90 that serves as a fixing member so that the head unit 1 can be fixed to a carriage. Taken as an example is, as shown in FIG. 18, a head unit 104 that fixes a plurality of actuator units, e.g., three actuator units 101, 102, 103 to a single flow path unit 100 and supplies ink from a total of six ink supply ports 27, 27, •••, i.e., two ink supply ports per actuator unit.

Reference numeral 90 denotes the head holder. At a lower portion of the head holder 90 is a recessed portion 91 that substantially matches the outer periphery of the head unit 104. At positions confronting the ink supply ports 27, 27 ••• of the head unit 104 is a connecting port 94 that communicates with an ink flow path 93 at the bottom thereof. Around the periphery of the connecting port 94 are edge portions **94*a*, 94*b*. Each of the edge portions 94*a*, 94*b* projects slightly, e.g., by 40 μm from the bottom 91*a* of the recessed portion 91** and has a width of about 150 μm.

Figure 16:
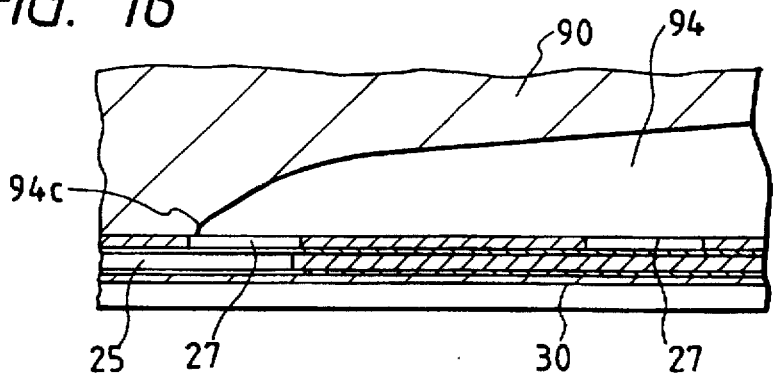
FIG. 16 is an enlarged view showing a relationship between an end of the connecting port of the head holder and the ink supply ports of the head unit.
Figure 15A:
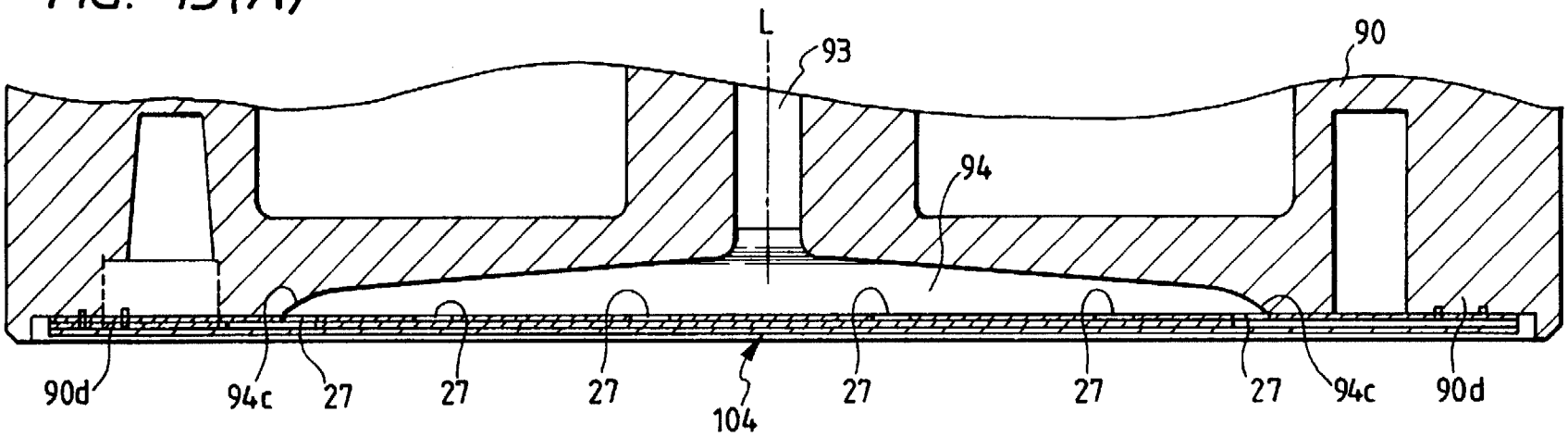
FIGS. 15(A) and (B) are a sectional view and a plan view respectively showing a structure for connecting ink supply ports of the head unit to a connecting port of the head holder.
Figure 15B:
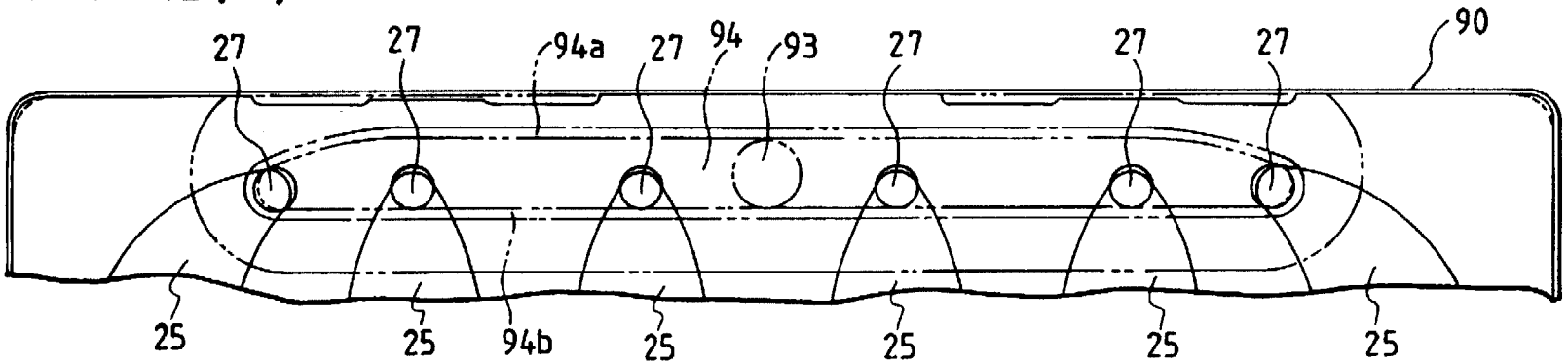

FIG. 15 shows an exemplary connecting port 94. The connecting port 94 is formed as a slender recessed portion slightly sloping down toward both ends thereof in such a manner as to be symmetrical with the ink flow path 93 as the line L of symmetry, which is also a line of symmetry of the head unit 104. The length of the connecting port 94 is set to a value slightly smaller than the region including the ink supply ports 27, 27, ••• so that the endmost portions **94*c* of the connecting port 94 pass over the corresponding ink supply ports 27, 27 to some extent as shown in FIG. 16**.

Further, the connecting port 94 has such a width as to overlap each ink supply port 27 on one side thereof, and is tapered toward both ends thereof. At the bottom ends of the connecting port 94 are the edge portions **94*a*, 94*b*** that project slightly from the surrounding surfaces as described above.

As a result of this construction, when the head unit 104 is inserted into the recessed portion 91 after an adhesive 95 has been applied to the bottom surface **91*a* of the recessed portion 91 of the head holder 90, which surface 91*a* is arranged outside the connecting port 94, positioning projections 90*d*, 90*d* of the head holder 90 are fitted into positioning holes (not shown) formed in the head unit 104 to allow the head unit 104** to be set to a predetermined position.

Since the edge portions **94*a*, 94*b* that project slightly toward the bottom surface 91*a* are formed along the peripheral edge of the connecting port 94, not only these edge portions 94*a*, 94*b* block the adhesive 95 from overflowing into the connecting port 94 but also a gap 97 between the recessed portion 91 and the head unit 104 absorbs the adhesive 95 even if the adhesive 95 overflows during the bonding of the holder 90 to the head unit 104. As a result, the area for connecting the ink supply ports 27, 27, ••• to the connecting port 94 can be regulated by the edge portions 94*a*, 94*b***.

When the ink is consumed due to printing in the thus constructed recording head, ink within a not shown ink cartridge flows into the reservoir chamber 25 via the ink supply ports 27, 27, ••• of the head unit 104.

Since the connecting port 94 is designed to be slightly tapered toward the endmost portions **94*c*, 94*c* thereof as viewed in the longitudinal direction and positioned so as to pass over the corresponding endmost ink supply portions 27, 27 to some extent, there is no likelihood that the flow of ink does not stop, meaning that air bubbles are not likely to stagnate at both endmost portions 94*c*, 94*c* of the connecting port 94. Further, since one of the edge portions 94*a*, 94*b* arranged across the width of the connecting portion 94, or the edge portion 94*b* in this embodiment is positioned so as to be flush against or slightly pass over the ink supply portions 27, 27, •••, it is ensured that the ink will not stagnate at least on the side of the ink supply ports 27, 27**, •••, thereby contributing to preventing the stagnation of air bubbles affecting the printing operation.

Figure 17:
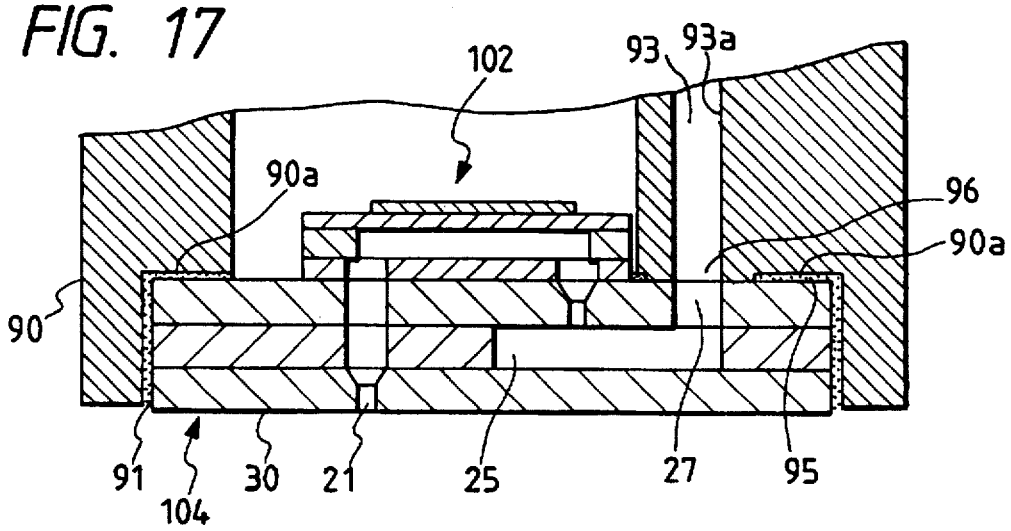
FIG. 17 is a sectional view showing a structure for attaching a head unit to a head holder, which is another embodiment of the invention.

While the edge portions **94*a*, 94*b* of the connecting port 94 are located slightly outside the ink supply portion 94 in the aforementioned embodiment, the overflowing of the adhesive to the connecting port 94 can be checked by reducing the amount of adhesive to be applied to a possible extent even if a connecting port 96 is formed so as to coincide with an inner peripheral surface 93*a* of the ink flow path 93 as shown in FIG. 17. Further, it is not necessary to provide an adhesive absorbing gap between the recessed portion 91 of the holder 90 on a side opposite to the ink flow path 93 (the left side as viewed in FIG. 17) and the head unit 104** because this region is remote from the ink supply route and therefore the overflowing of the adhesive in this region will not affect the performance of the recording head.

What is claimed is:

1. An inkjet recording head integrally formed by sequentially laminating:

a resilient plate for forming a vibration member having piezoelectric vibration elements on a surface thereof;

a pressure producing chamber forming plate for forming pressure producing chambers with a surface thereof sealed by the resilient plate;

a seal plate an other surface of the pressure producing chamber forming plate and having therethrough a plurality of communication paths and ink supply communication paths, each communication path and each ink supply communication path communicating with a selected corresponding pressure producing chamber at a respective end portion of the pressure producing chamber;

an ink supply constricted port forming plate having first ink supply constricted ports for imparting fluid resistance to ink supply paths to the pressure producing chambers and having communication paths communicating with the pressure producing chambers;

a reservoir chamber forming plate having a reservoir chamber communicating with the pressure producing chambers through the ink supply constricted ports and communication paths communicating with the pressure producing chambers, and a nozzle plate sealing other surface of the reservoir chamber forming plate and having nozzles connected to the pressure producing chambers through the communication paths, such that each ink supply communication path is formed so that one end thereof is arranged outside a region confronting the pressure producing chamber at a region confronting the reservoir chamber; and each first ink supply constricted port is positioned at a portion of the ink supply communication path, the portion being remotest from the pressure producing chamber.

2. An ink jet recording head according to claim 1, wherein both the ink supply communication paths and the first ink supply constricted ports are defined as empty spaces formed in the seal plate and the ink supply constricted port forming plate, respectively; and these plates are laminated so as to interpose the pressure producing chamber forming plate therebetween.

3. An ink jet recording head according to claim 1, wherein the resilient plate, the pressure producing chamber forming plate having windows for defining the pressure producing chambers, and the seal plate are formed as an integrally sintered ceramic body by lamination with green sheets; and the piezoelectric vibration elements are formed on a surface of the resilient plate so as to correspond to the pressure producing chambers.

4. An ink jet recording head according to claim 1, wherein a length from the first ink supply constricted port to a position at which the ink supply communication path is connected to the pressure producing chamber is set to a value equal to or larger than a sectional dimension of the ink supply communication path.

5. An ink jet recording head according to claim 1, wherein second ink supply constricted ports are formed at positions of the ink supply communication paths corresponding to the pressure producing chambers in the ink supply constricted port forming plate.

6. An ink jet recording head according to claim 1, wherein each second ink supply constricted port has a fluid resistance larger than each first ink supply constricted port.

7. An ink jet recording head according to claim 1, wherein each of the first and the second ink supply constricted ports is tapered.

8. An ink jet recording head according to claim 1, wherein a plurality of ink supply communication paths belonging to endmost regions of the reservoir chamber have lengths thereof designed so as to be staggered across the width of the reservoir chamber.

9. A laminated ink jet recording head integrally formed by sequentially laminating:

a resilient plate for forming a vibration member having piezoelectric vibration elements on a surface thereof;

a pressure producing chamber forming member for forming pressure producing chambers with a surface thereof sealed by the resilient plate;

a seal plate sealing an other surface of the pressure producing chamber forming member and having therethrough a plurality of communication holes and ink supply paths, each communication hole and each ink supply path communicating with a selected corresponding pressure producing chamber at both a respective end portion of the pressure producing chamber, an ink supply constricted port forming plate having first ink supply constricted ports for imparting fluid resistance to ink supply paths to the pressure producing chambers and having communication holes communicating with the pressure producing chambers;

a reservoir chamber forming plate having a reservoir chamber communicating with the pressure producing chambers through the ink supply constricted ports and communication holes communicating with the pressure producing chambers; and a nozzle plate sealing other surface of the reservoir chamber forming plate and having nozzles connected to the pressure producing chambers through the communication holes, such that each ink supply constricted port is formed one-sidedly toward a wall surface of the reservoir chamber, the wall surface being remote from the side of the nozzles; and dummy pressure producing chambers are formed at and most regions of the reservoir chamber and a plurality of ink supply constricted ports are formed across the width of the reservoir chamber so as to communicate with We dummy pressure producing chambers.

10. A laminated ink jet recording head according to claim 9, wherein a plurality of nozzles are formed so as to communicate with the dummy pressure producing chambers.

11. An ink jet recording head comprising a head unit being formed by fixing an actuator unit to a flow path unit, the actuator unit being formed by integrating a pressure producing chamber forming plate for forming pressure producing chambers, a resilient plate for sealing a surface of the pressure producing chamber forming plate and having piezoelectric vibration elements being displaced by flexing, and a seal plate for sealing other surface of the pressure producing chamber forming plate with one another, the flow path unit being formed by integrating a reservoir chamber forming plate for forming a reservoir chamber, an ink supply constricted port forming plate sealing a surface of the reservoir chamber forming plate, having ink supply ports for receiving ink from an ink tank, and fixing the actuator unit thereto, and a nozzle plate sealing other surface of the reservoir chamber and having nozzles communicating with the pressure producing chambers, the head unit being fixed to a holder by applying an adhesive to a region outside edge portions of the holder, the holder having a connecting port, the connecting port communicating with the ink tank through an ink flow path, having ink supply ports surrounded by peripheral edges thereof, and having the edge portions projecting from surfaces surrounding the connecting port.

12. An ink jet recording head according to claim 11, wherein a plurality of actuator units are fixed to the flow path unit; and the connecting port is formed slender so as to cover the ink supply ports.

13. An ink jet recording head according to claim 11, wherein the connecting port is formed so that both ends thereof pass over the corresponding ink supply ports.

14. An ink jet recording head according to claim 11, wherein the connecting port is formed so that an edge portion in the width direction thereof is flush with an end of each of the ink supply ports or passes over such end.

* * * * *